US011564026B2

(12) United States Patent
Ji et al.

(10) Patent No.: US 11,564,026 B2
(45) Date of Patent: Jan. 24, 2023

(54) EARPHONE HAVING PRESSURE EQUILIBRIUM STRUCTURE

(71) Applicant: EM-TECH Co., Ltd., Gyeongsangnam-do (KR)

(72) Inventors: Yong Ju Ji, Gyeongsangnam-do (KR); Jun Hee Han, Gyeongsangnam-do (KR); Young Woo Kim, Gyeongsangnam-do (KR)

(73) Assignee: EM-TECH CO., LTD., Gyeongsangnam-Do (KR)

( * ) Notice: Subject to any disclaimer, the term of this patent is extended or adjusted under 35 U.S.C. 154(b) by 0 days.

(21) Appl. No.: 17/363,922

(22) Filed: Jun. 30, 2021

(65) Prior Publication Data

US 2022/0007101 A1 Jan. 6, 2022

(30) Foreign Application Priority Data

Jul. 2, 2020 (KR) ..... 10-2020-0081461

(51) Int. Cl.
*H04R 1/10* (2006.01)
*H04R 9/02* (2006.01)

(52) U.S. Cl.
CPC ..... *H04R 1/1016* (2013.01); *H04R 9/025* (2013.01)

(58) Field of Classification Search
CPC .... H04R 1/023; H04R 1/1086; H04R 1/1016; H04R 1/1083; H04R 7/06; H04R 7/18; H04R 9/025; H04R 9/06; H04R 9/04; H04R 2209/027; H04R 2460/11
See application file for complete search history.

(56) References Cited

U.S. PATENT DOCUMENTS

2012/0070022 A1* 3/2012 Saiki ..... H04R 9/063 381/351
2014/0301591 A1* 10/2014 Yang ..... H04R 1/1016 381/380
2020/0221205 A1* 7/2020 Park ..... H04R 1/1091

FOREIGN PATENT DOCUMENTS

KR 101558091 B1 10/2015
KR 102097472 B1 4/2020

* cited by examiner

*Primary Examiner* — Alexander Krzystan
*Assistant Examiner* — Julie X Dang
(74) *Attorney, Agent, or Firm* — Murphy, Bilak & Homiller, PLLC

(57) ABSTRACT

Provided is an earphone having a pressure equilibrium structure capable of preventing a decrease in acoustic characteristics or sound pressure, while having a structure capable of achieving equilibrium within an ear canal. The earphone includes a receiver including a frame, a magnetic circuit, a voice coil, and a diaphragm, a front housing surrounding a front and a side surface of the receiver and including a sound tube, a rear housing attached to a rear of the receiver and coupled to the front housing, and a duct located between the diaphragm and the sound tube. An acoustic path through which sound is emitted is formed from the receiver to an end of the sound tube. The front housing or the rear housing includes a leakage hole. An inner end of the duct is connected to the acoustic path. An outer end of the duct is connected to the leakage hole.

12 Claims, 13 Drawing Sheets

EARPHONE HAVING PRESSURE EQUILIBRIUM STRUCTURE

TECHNICAL FIELD

The present disclosure relates to an earphone having a pressure equilibrium structure.

BACKGROUND

Earphones are classified into closed type earphones in which all other portions, excluding a sound emission hole inserted into an ear canal, are blocked and open type earphones including a tuning hole and a duct in addition to a sound emission hole.

The closed type earphone is to deliver sound of a receiver installed in the earphone directly to the user's ear, enabling listening to sound even with small power. In particular, a kernel-type earphone inserted into the user's ear through an earpiece includes excellent sound insulation properties that block external noise.

However, in the case of a kernel-type earphone, as the ear canal is completely sealed, a pressure difference is made between the inside and outside of the ear canal, and thus, some may feel pressure in the ears or the others may feel uncomfortable.

FIG. 1 is a view illustrating a kernel-type earphone equipped with a pressure equilibrium means according to the related art. The kernel-type earphone according to the related art a speaker unit 1 and a housing accommodating the speaker unit 1 and including a front housing 10 and a rear housing 20. The speaker unit 1 installed inside the housing includes a cylindrical frame, a magnetic circuit installed inside the frame, and a diaphragm vibrating up and down by magnetic force of the magnetic circuit. The frame, that is, an exterior of the speaker unit 1, includes a cylindrical shape, and an inner circumferential surface of the front housing 10 and an outer circumferential surface of the speaker unit 1 are in contact with the speaker unit 1 so that the speaker unit seals a portion between the front and the rear of the speaker unit within the front housing 10.

Here, the kernel-type earphone forms a sound tube 12 in front of the front housing 10, and a sealed ear tip formed of rubber or sponge material is mounted on the sound tube 12. Therefore, the kernel-type earphone seals the ear canal and the outside, so that when the kernel-type earphone is worn and used, air is sealed around the ear canal and air is compressed in the ear. The compressed air in the ear compresses the eardrum, causing a feeling of stuffiness and discomfort. Therefore, an intentional leakage hole is required to attenuate hearing and leak air pressure.

In the case of the related art, a leakage hole 14 for leaking air from the front of the diaphragm to the front of the front housing 10 is installed as shown in FIG. 1, a leakage hole 14*a* that leaks air in front of the diaphragm to the side of the front housing 10*a* is installed as shown in FIG. 2, or air from the front of the diaphragm is leaked to the rear housing 20 by way of the rear of the front housing 10*a* through a duct 14*b*. However, in this method, external leakage sound occurs and acoustic characteristics are deteriorated due to sound interference.

In addition, in the case of a front leakage hole 14 or a side leakage hole 14*a*, a length of the leakage holes 14 and 14*a* is the same as a thickness of the front housing 10, and thus, the front leakage hole 14 or the side leakage hole 14*a* does not serve as a duct. In addition, a main sound actually received into the ear through the sound tube 12 is divided into a sub-sound by the leakage holes 14 and 14*a*, and accordingly, a negative pressure of the main sound is lowered and transmitted to the eardrum.

As shown in FIG. 3, when air pressure of air on the front of the diaphragm moves to the rear of the housing through the duct 14*b*, sound interference occurs between a front sound and a rear sound, which is also a major cause of deterioration in acoustic properties.

Therefore, in the case of the receiver including the pressure equilibrium means according to the related art, pressure equilibrium may be obtained but acoustic characteristics and a sound pressure decreases.

SUMMARY

An aspect of the present disclosure provides an earphone having a pressure equilibrium structure capable of preventing a decrease in acoustic characteristics or sound pressure, while having a structure capable of achieving pressure equilibrium within an ear canal.

According to an aspect of the present disclosure, an earphone having a pressure equilibrium structure includes: a receiver including a frame, a magnetic circuit, a voice coil, and a diaphragm; a front housing surrounding a front and a side surface of the receiver and including a sound tube; a rear housing attached to a rear of the receiver and coupled to the front housing; and a duct located between the diaphragm and the sound tube, wherein an acoustic path through which sound is emitted is formed from the receiver to an end of the sound tube, the front housing or the rear housing includes a leakage hole, an inner end of the duct is connected to the acoustic path, and an outer end of the duct is connected to the leakage hole.

As another example of the present disclosure, the receiver may further include a protector coupled to the frame of the receiver to protect the diaphragm and disposed to be in contact with the front housing, and the duct may be formed by a groove located on a front surface of the protector in contact with the front housing.

As another example of the present disclosure, the leakage hole may penetrate a front surface or the rear surface of the front housing.

As another example of the present disclosure, the leakage hole may be formed in the rear housing, and the protector may include a connection path formed by the groove on an outer surface and connected to the duct.

As another example of the present disclosure, the receiver may further include a protector coupled to the frame to protect the diaphragm and disposed to be in contact with the front housing, and the duct may be formed by a groove located on a rear surface of the front housing in contact with the protector.

As another example of the present disclosure, the leakage hole may penetrate a front surface or a side surface of the front housing.

As another example of the present disclosure, the leakage hole may be formed in the rear housing, and the protector may include a connection path formed by a groove on an outer surface and connected to the duct.

As another example of the present disclosure, the earphone may further include: a plate for duct formation coupled to an inner surface of the front housing located at the front.

As another example of the present disclosure, the plate for duct formation may include a through-hole in the center thereof and include a groove connected to the through-hole on a surface in contact with the front housing and forming a duct.

As another example of the present disclosure, the plate for duct formation may include a first plate including a through-hole and a second plate including a hole forming the duct.

As another example of the present disclosure, the duct may have a spiral shape.

In the earphone including a pressure equilibrium structure, the structure for pressure equilibrium goes through the duct before being connected to the leakage hole of the housing, so that a change in acoustic characteristics due to sound leakage may be prevented.

In addition, in the earphone including a pressure equilibrium structure provided in the present disclosure, since the duct is formed by a groove formed by deleting some of a protector, a housing, or a separate plate, a length of the duct may be easily adjusted without changing a design of other components.

Those skilled in the art will recognize additional features and advantages upon reading the following detailed description, and upon viewing the accompanying drawings.

DETAILED DESCRIPTION

Hereinafter, embodiments of the present disclosure will be described in detail with reference to the accompanying drawings.

Figure 1:
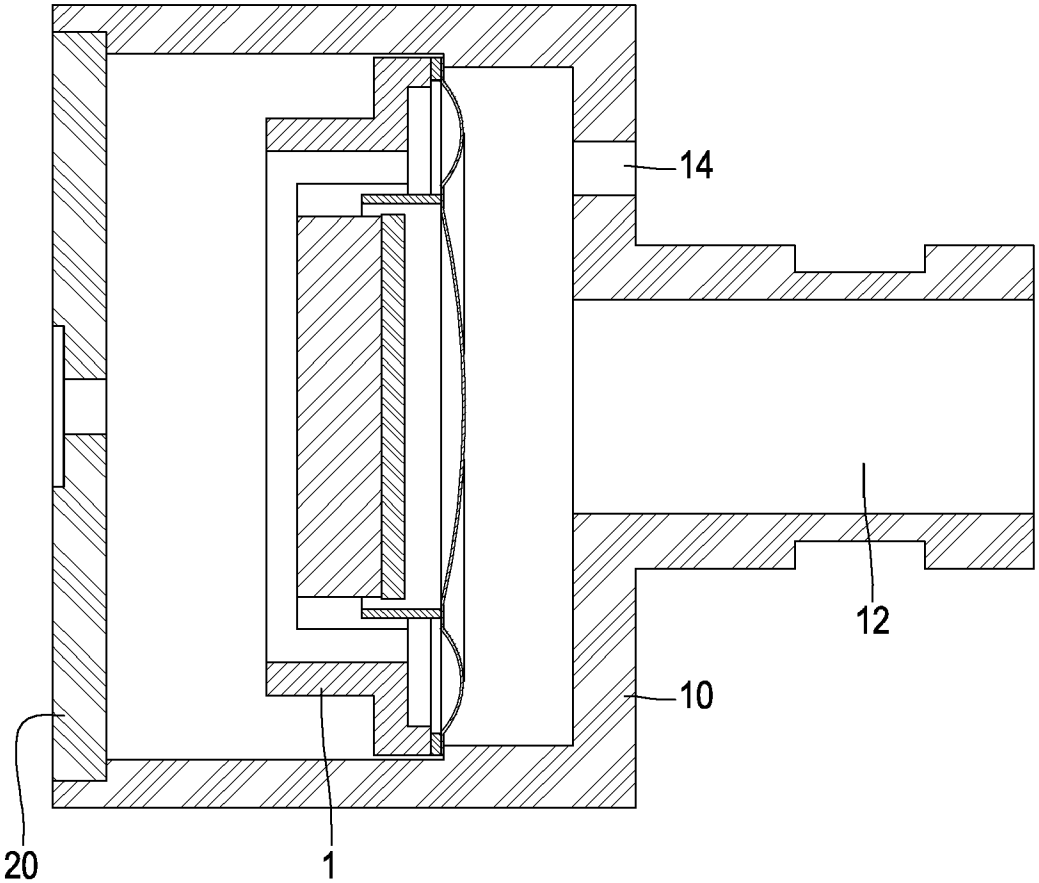
FIG. 1 is a view illustrating a kernel-type earphone having a pressure equilibrium means according to the related art.
Figure 2:
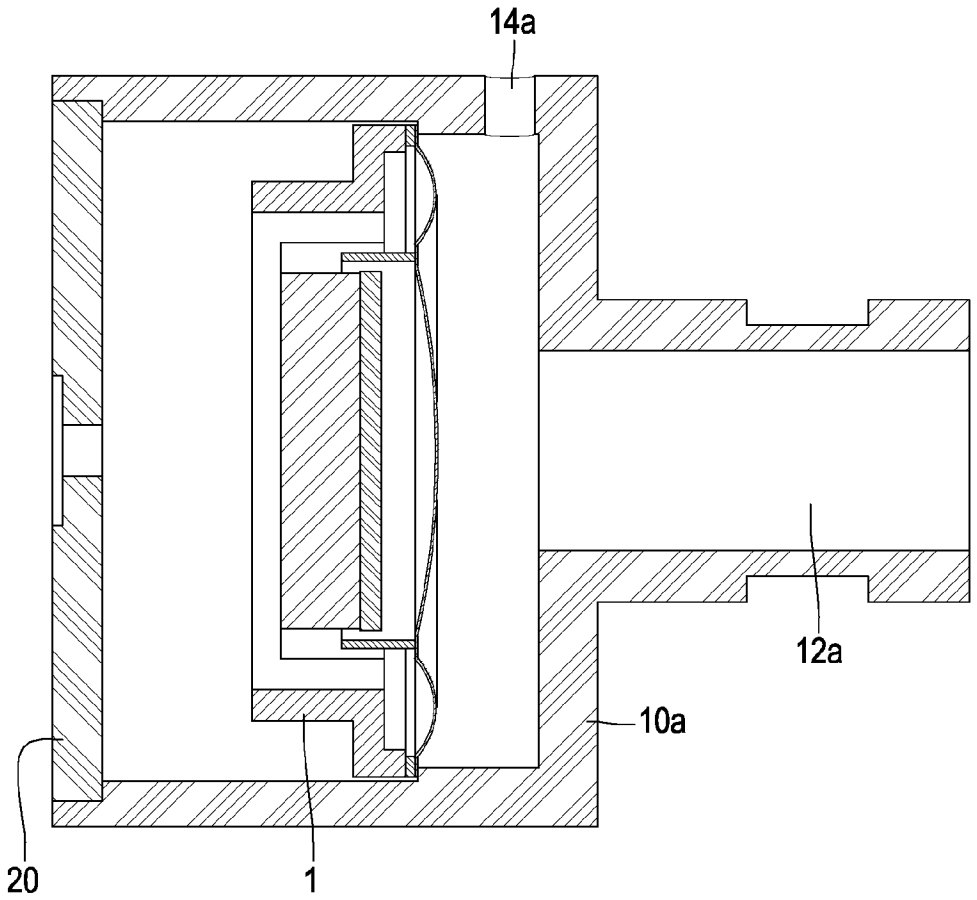
FIG. 2 is a view illustrating a kernel-type earphone having a pressure equilibrium means according to another related art.
Figure 3:
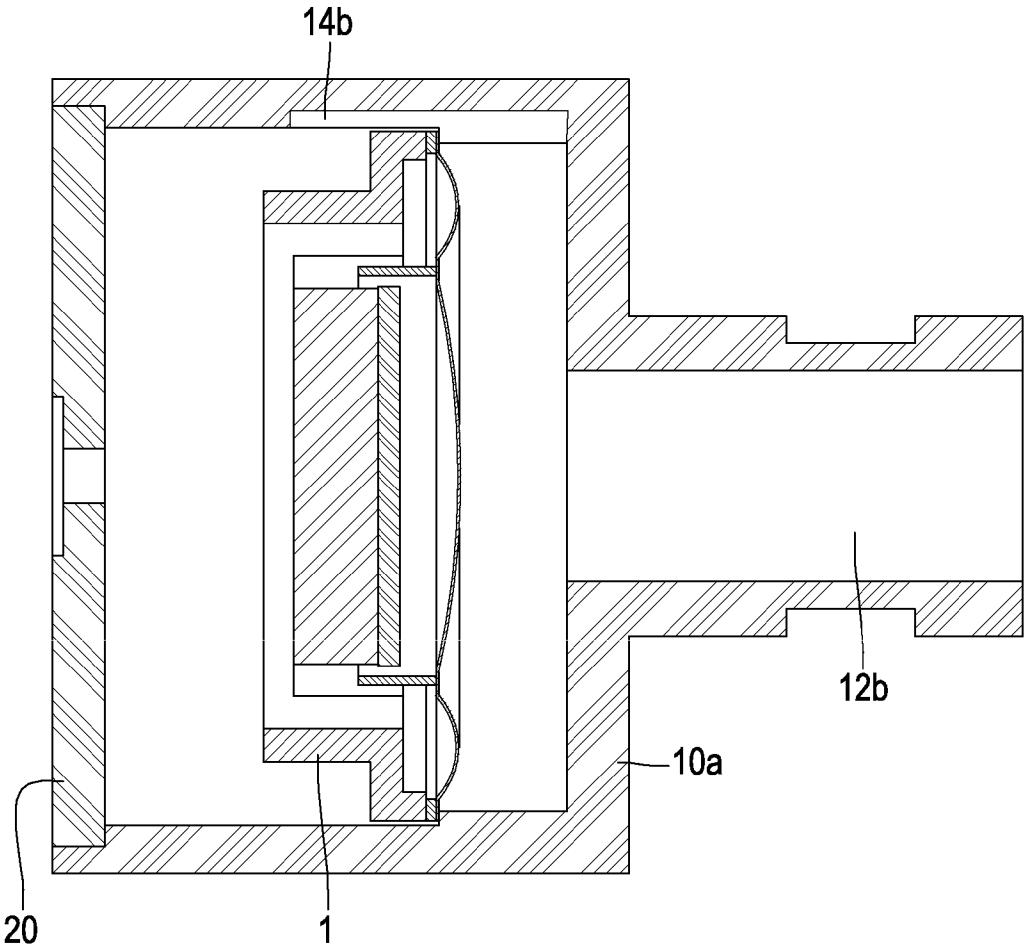
FIG. 3 is a view illustrating a kernel-type earphone having a pressure equilibrium means according to another related art.
Figure 4:
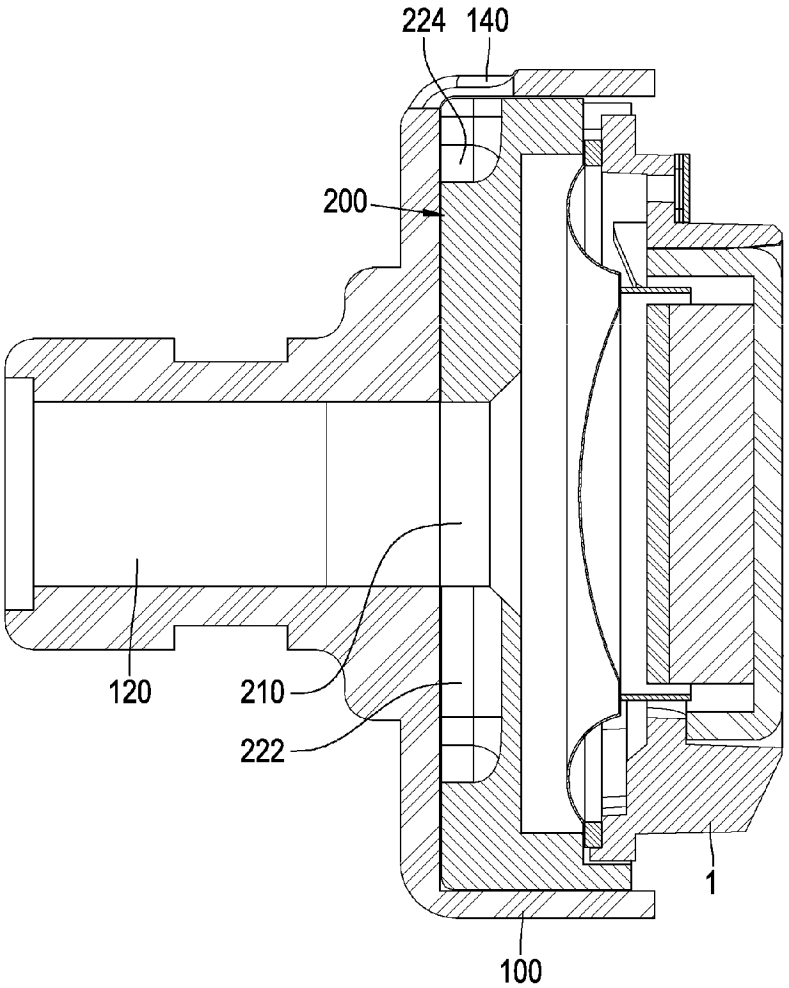
FIG. 4 is a cross-sectional view of an earphone having a pressure equilibrium means according to a first embodiment of the present disclosure.
Figure 5:
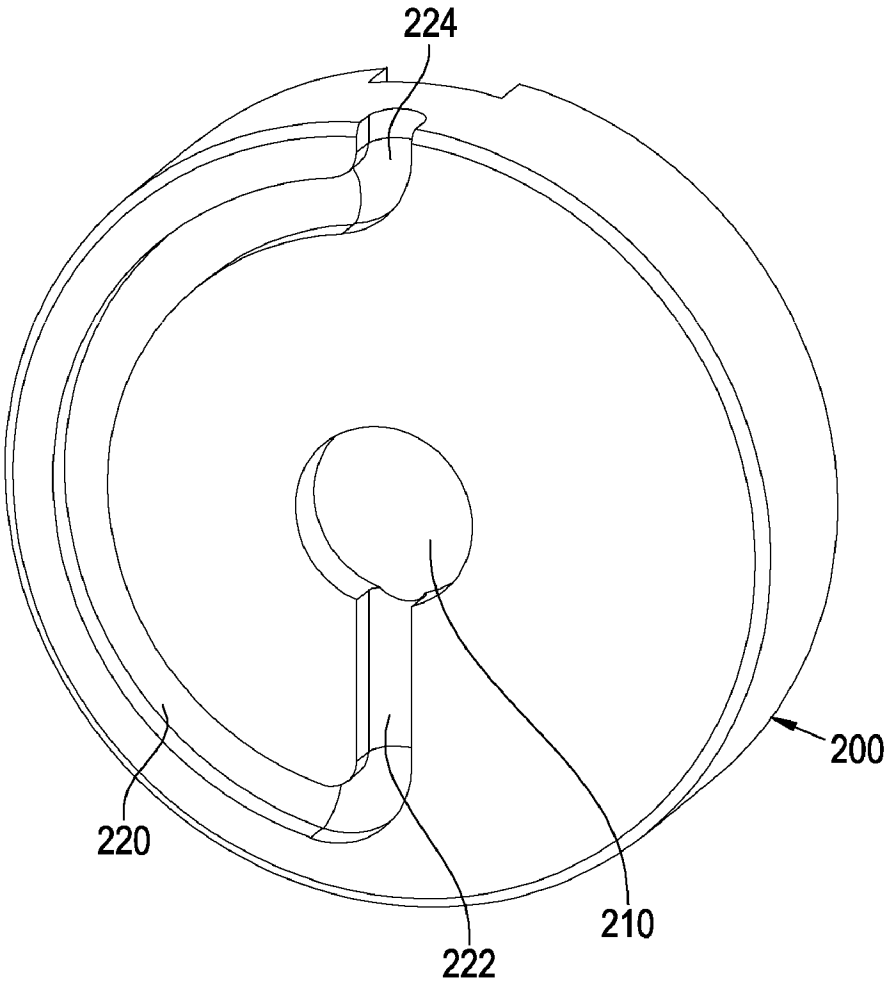
FIG. 5 is a view illustrating a protector provided in an earphone having a pressure equilibrium means according to the first embodiment of the present disclosure.
Figure 6:
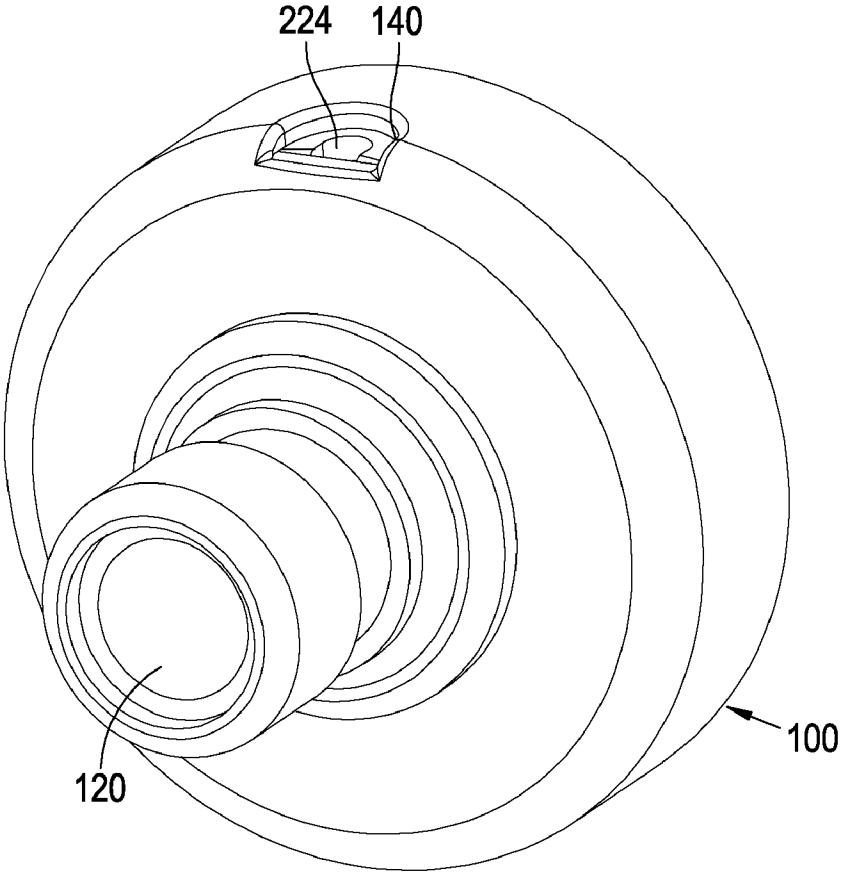
FIG. 6 is a front perspective view of an earphone having a pressure equilibrium means according to the first embodiment of the present disclosure.

FIG. 4 is a cross-sectional view of an earphone having a pressure equilibrium means according to a first embodiment of the present disclosure, FIG. 5 illustrates a protector including an earphone having a pressure equilibrium means according to the first embodiment of the present disclosure, and FIG. 6 is a front perspective view of an earphone having a pressure equilibrium means according to the first embodiment of the present disclosure.

A first embodiment of the present disclosure includes a receiver 1 including a frame, a magnetic circuit, a voice coil, and a diaphragm, and includes front housing 100 surrounding a front and a side surface of the receiver 1 and including a sound tube 120, and a rear housing (not shown) attached to a rear of the receiver 1 and coupled to the front housing 100. The rear housing (not shown) is not shown, and in the case of a wireless earphone, a battery or the like may be mounted in the rear housing (not shown) if necessary.

In the present disclosure, a path through which sound flows from the receiver 1 to the end of the sound tube 120 externally, that is, an acoustic path, is formed. In addition, the earphone of the present disclosure includes a duct located between the diaphragm of the receiver 1 and the sound tube 120, and the inner end of the duct is connected to the acoustic path.

A first embodiment of the present disclosure includes a protector 200 coupled to the front of the receiver 1. A front surface of the protector 200 is in contact with an inner surface of the front housing 100. Here, the protector 200 may include a through-hole 210 for emitting sound in the center thereof, and the through-hole 210 forms an acoustic path together with the sound tube 120.

The duct is formed by a groove 220 formed on the front surface of the protector 200. The duct is defined by the groove 220 and the inner surface of the front housing 100. Here, an inner end 222 of the groove 220 is connected to the through-hole 210, and an outer end 224 of the groove 220 extends to an outer periphery of the protector 200. The front housing 100 includes a leakage hole 140 at a position corresponding to the outer end 224 of the groove 220. Therefore, when excessive air pressure is generated in the ear due to an operation of the receiver 1, air may flow out through the leakage hole 140, and as the air leaks through the duct, pressure may gradually leak and sound leakage is also may be prevented. In addition, a short leakage hole 140 is a cause of sound deterioration in the related art earphones having a pressure equilibrium structure, and such sound deterioration may be prevented by forming a long duct.

Figure 7:
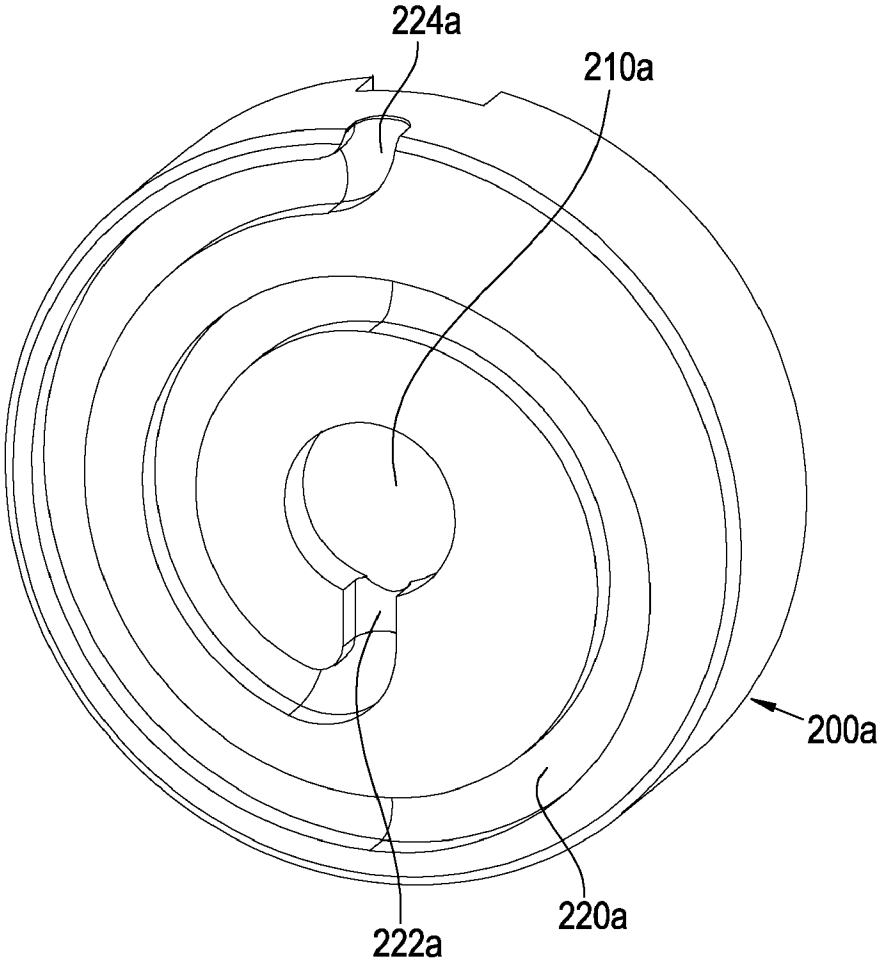
FIG. 7 is a view illustrating another example of a protector provided in an earphone having a pressure equilibrium means according to the first embodiment.

FIG. 7 is a view illustrating another example of a protector provided in an earphone having a pressure equilibrium means according to the first embodiment. A groove **220*a* formed in a protector 200*a* has a spiral shape. By adjusting a length of the spiral groove 220*a*, a length of the duct may be easily modified. That is, there is an advantage that the length of the duct may be easily adjusted without changing a design of the other components of the receiver 1, the front housing 100**, or the rear housing.

Figure 8:
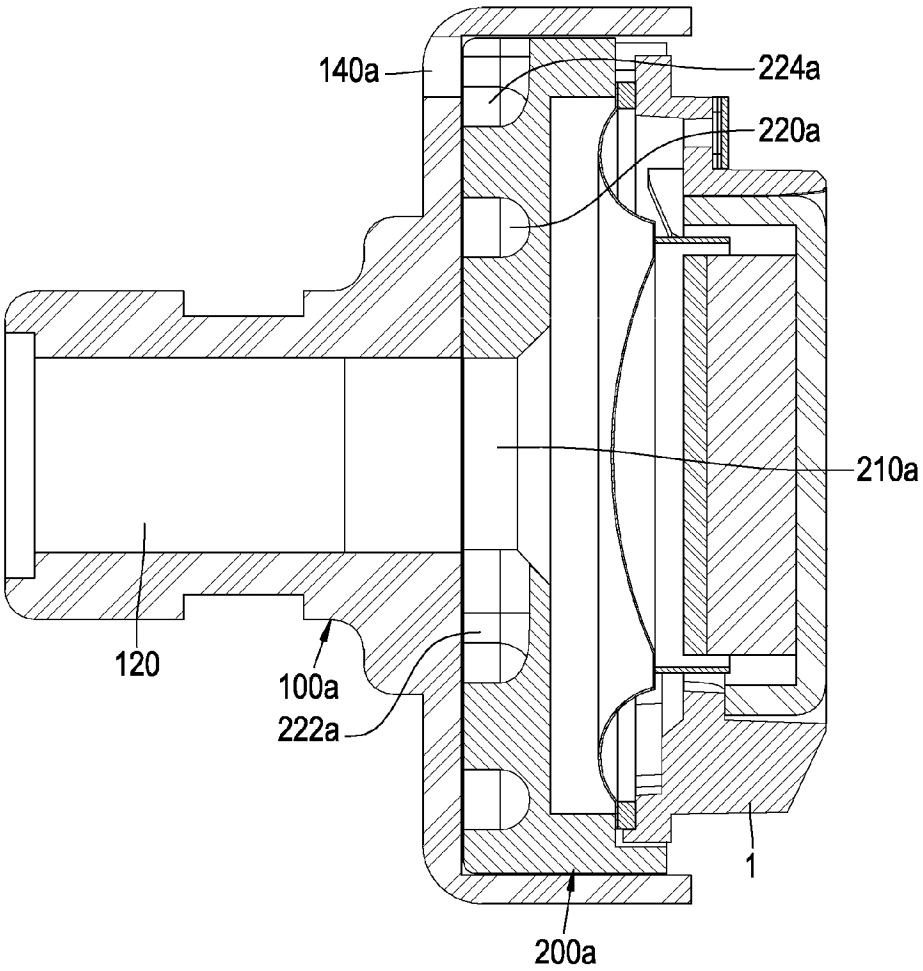
FIG. 8 is a cross-sectional view of an earphone having a pressure equilibrium means according to a second embodiment of the present disclosure.

FIG. 8 is a cross-sectional view of an earphone having a pressure equilibrium means according to a second embodiment of the present disclosure.

The earphone having a pressure equilibrium means according to the second embodiment of the present disclosure is the same as the first embodiment except that a leakage hole **140*a* is formed in front of a front housing 100*a*. Only a position of the leakage hole 140*a* provided in the front housing 100*a*** is changed to a position from which air pressure may be discharged to the front. In the second embodiment of the present disclosure, the protector of FIG.

7 in which the groove 220*a* formed in the protector 200*a* is long is applied. However, a protector including a short groove as shown in FIG. 5 may also be applied.

Figure 9:
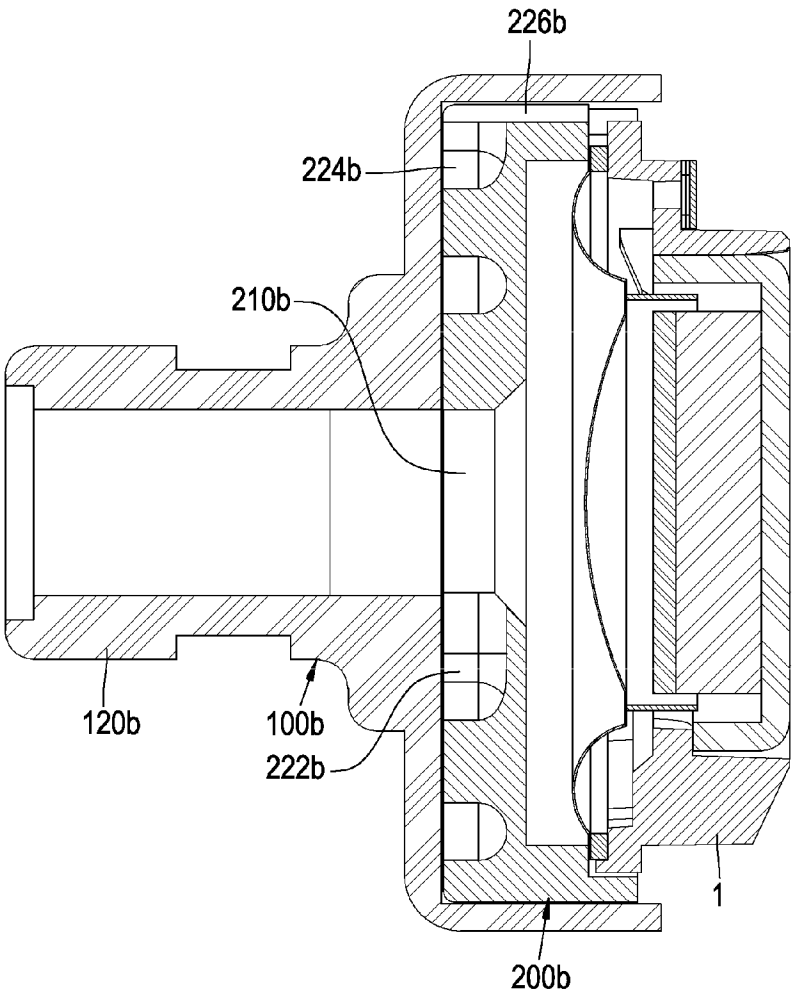
FIG. 9 is a cross-sectional view of an earphone having a pressure equilibrium means according to a third embodiment of the present disclosure.

FIG. 9 is a cross-sectional view of an earphone having a pressure equilibrium means according to a third embodiment of the present disclosure. In the third embodiment of the present disclosure, a protector 200*b* coupled to the front of the receiver 1 is provided. A front surface of the protector 200*b* is in contact with an inner surface of the front housing 100*b*. Here, the protector 200*b* may include a through-hole 210*b* for emitting sound in the center thereof, and the through-hole 210*b* forms an acoustic path together with a sound tube 120*b*.

A duct is formed by a groove 220*b* formed on the front surface of the protector 200*b*. The duct is defined by the groove 220*b* and the inner surface of the front housing 100*b*. Here, an inner end 222*b* of the groove 220*b* is connected to the through-hole 210*b*, and an outer end 224*b* of the groove 220*b* extends to an outer periphery of the protector 200*b*.

Here, the third embodiment is different from the first embodiment and the second embedment in that the front housing 100 does not include a leakage hole in a position corresponding to the outer end 224 of the groove 220. Instead, a connection path 226*b* is formed on an outer surface of the protector 220*b* in contact with a side surface of the front housing 100. The connection path 226*b* is connected to the end of the duct, that is, the outer end 224*b* of the groove 220*b*. The connection path 226*b* discharges air pressure to the rear of the receiver 1, that is, to the rear housing side. Here, a leakage hole (not shown) is formed in the rear housing (not shown) to allow air to flow out rearwards. In the third embodiment of the present disclosure, the protector of FIG. 7 in which the groove 220*b* formed in the protector 200*b* is long is applied. However, a protector including a short groove length as shown in FIG. 5 may also be applied.

Figure 10:
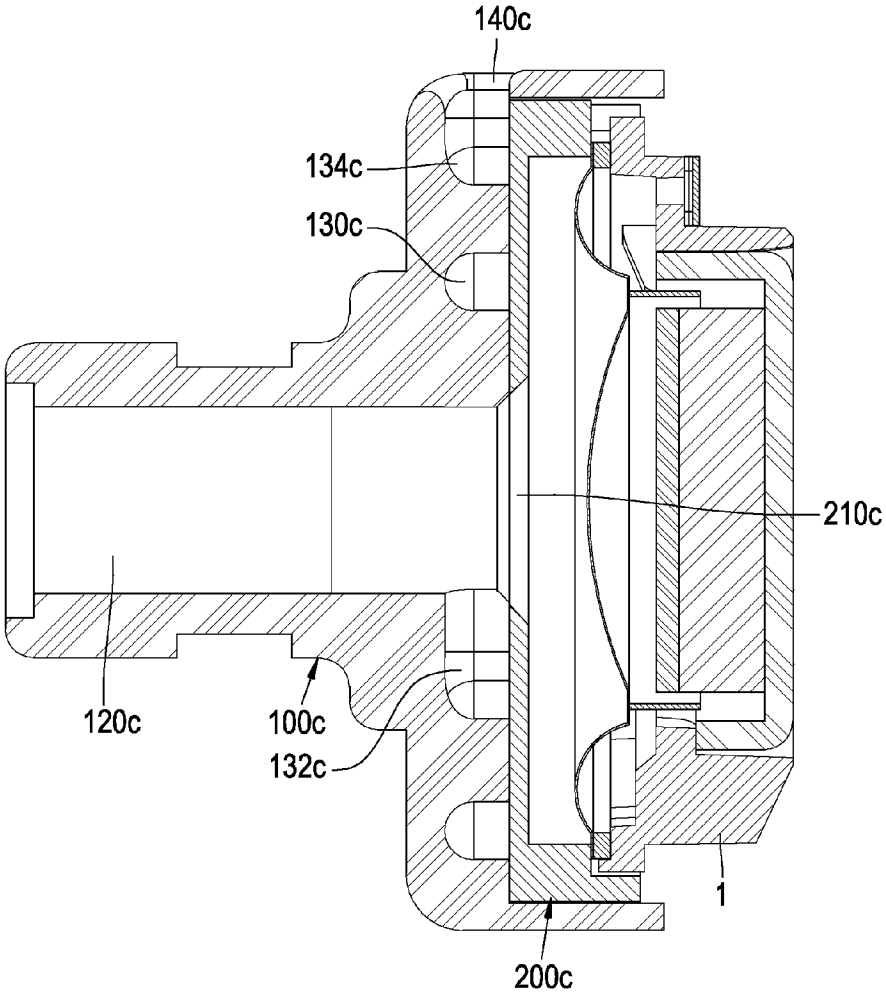
FIG. 10 is a cross-sectional view of an earphone having a pressure equilibrium means according to a fourth embodiment of the present disclosure.
Figure 11:
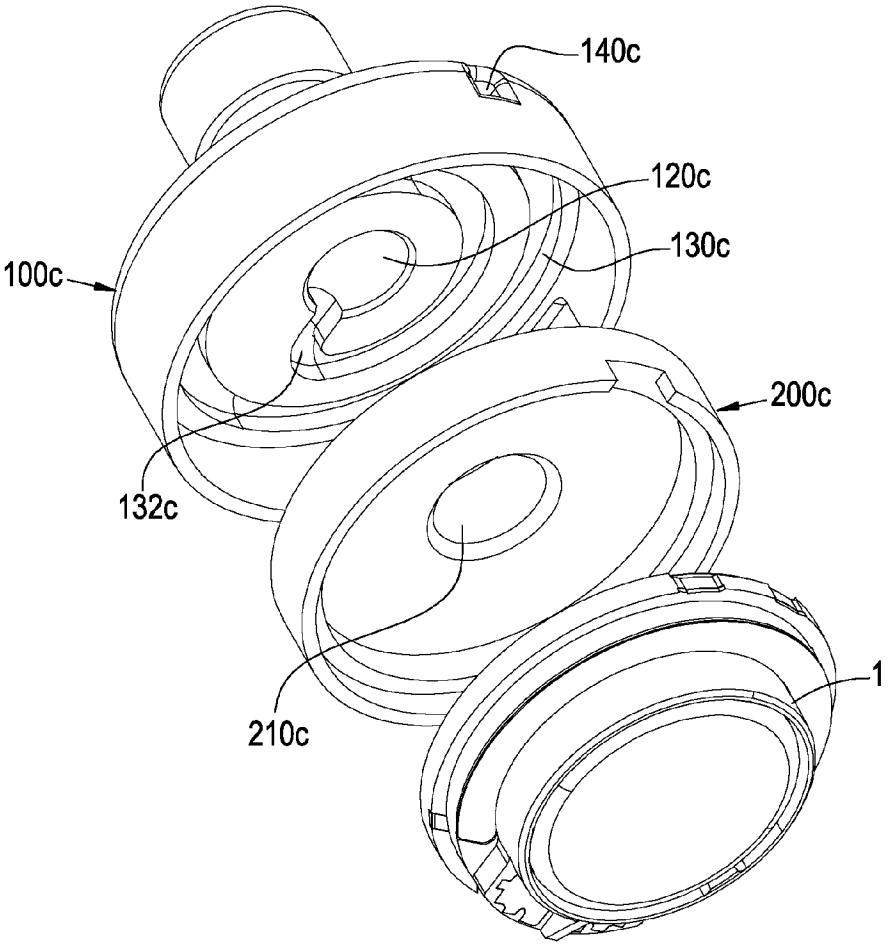
FIG. 11 is an exploded view of an earphone having a pressure equilibrium means according to the fourth embodiment of the present disclosure.

FIG. 10 is a cross-sectional view of an earphone having a pressure equilibrium means according to a fourth embodiment of the present disclosure, and FIG. 11 is an exploded view of an earphone having a pressure equilibrium means according to a fourth embodiment of the present disclosure.

In the fourth embodiment of the present disclosure, a protector 200*c* coupled to the front of the receiver 1 is provided. A front surface of the protector 200*c* is in contact with an inner surface of a front housing 100*c*. Here, the protector 200*c* may include a through-hole 210*c* for emitting sound in the center thereof, and the through-hole 210*c* forms an acoustic path together with a sound tube 120*c*.

The fourth embodiment of the present disclosure does not have a groove on a front surface of the protector 200*c*. Instead, a duct is formed by a groove 130*c* formed on an inner surface of the front housing 100*c*. A duct is defined by the groove 130*c* and the front surface of the protector 200*c*. Here, an inner end 132 of the groove 130*c* is connected to a sound tube 120*c*, and an outer end 134*c* of the groove 130*c* is connected to a leakage hole 140*c* penetrating a side wall of the front housing 100*c*.

Here, the leakage hole 140*c* provided in the front housing 100*c* may be formed toward the front rather than the side. In addition, the front housing 100*c* may not have a leakage hole, and as in the third embodiment, a connection path may be formed on an outer surface of the protector 220*c* in contact with a side surface of the front housing 100*c*, and the air pressure may be discharged to the rear of the receiver 1, that is, toward a rear housing through the connection path.

Here, a leakage hole (not shown) is formed in the rear housing (not shown) and allows air to flow out rearwards. In the third embodiment of the present disclosure, the protector of FIG. 7 in which the groove 220*b* formed in the protector 200*b* is long is applied. However, a protector including a short groove length as shown in FIG. 5 may also be applied.

Figure 12:
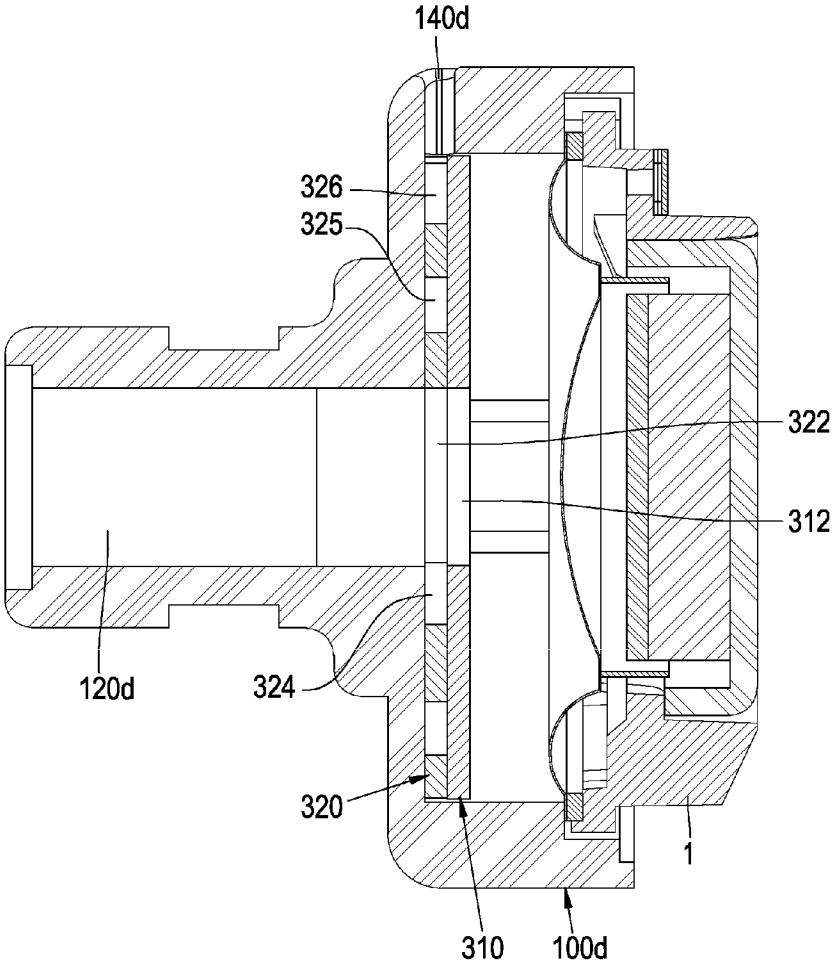
FIG. 12 is a cross-sectional view of an earphone having a pressure equilibrium means according to a fifth embodiment of the present disclosure.
Figure 13:
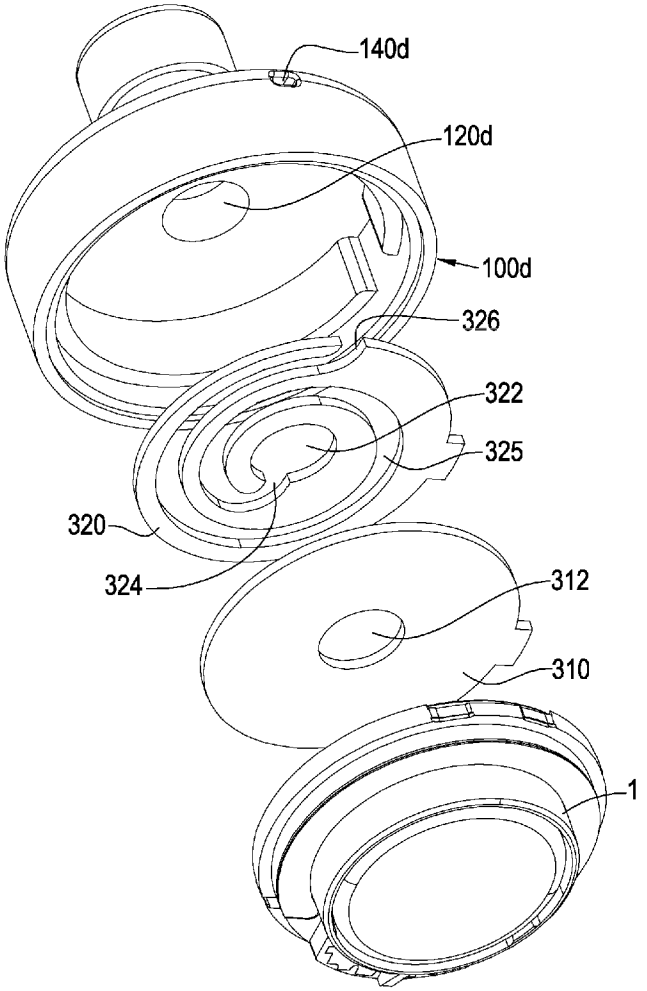
FIG. 13 is an exploded view of an earphone having a pressure equilibrium means according to the fifth embodiment of the present disclosure.

FIG. 12 is a cross-sectional view of an earphone having a pressure equilibrium means according to a fifth embodiment of the present disclosure, and FIG. 13 is an exploded view of an earphone having a pressure equilibrium means according to a fifth embodiment of the present disclosure.

According to the fifth embodiment of the present disclosure, plates 310 and 320 for duct formation coupled to an inner surface of a front housing 100*d* located in front of the receiver 1 are provided.

The plates 310 and 320 for duct formation may include through-holes 312 and 322 in the center thereof, and the through-holes 312 and 322 are connected to a sound duct 120*d* of the front housing 100*d* to form an acoustic path.

The plates 310 and 320 for duct formation includes a first plate 310 having a planar shape and located at the rear and a second plate 320 located in front of the first plate 310 and in contact with the inner surface of the front housing 100*d*. A plate 320 is provided. The second plate 320 may include a spiral hole 325 having an inner end 324 connected to the through-hole 322 and an outer end 326 extending to the outer periphery to form a duct. In the fifth embodiment of the present disclosure, the first plate 310 and the second plate 320 including a hole 325 to form a duct are separately manufactured for convenience of machining, but a recess, rather than a hole, may also be machined for duct formation to manufacture a single plate.

In the fifth embodiment of the present disclosure, a leakage hole 140*d* is located on the side, but alternatively, the leakage hole 140*d* of the front housing 100*d* may be formed toward the front instead of the side. In addition, the front housing 100*d* may not have a leakage hole, and a connection path may be formed with the inner surface of the front housing 100*d* so as to be connected to the outer end 326 of the plates 310 and 320, and air pressure may be discharged to the rear of the receiver 1, i.e., toward the rear housing, through the connection path. Here, a leakage hole (not shown) is formed in the rear housing (not shown) to allow air to flow out to the rear.

In the third embodiment of the present disclosure, the protector of FIG. 7 in which the groove 220*b* formed in the protector 200*b* is long is applied. However, a protector including a short groove length as shown in FIG. 5 may also be applied.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. An earphone having a pressure equilibrium structure, the earphone comprising:

a receiver including a frame, a magnetic circuit, a voice coil, and a diaphragm;

a front housing surrounding a front and a side surface of the receiver and including a sound tube;

a rear housing attached to a rear of the receiver and coupled to the front housing; and a duct located between the diaphragm and the sound tube, wherein an acoustic path through which sound is emitted is formed from the receiver to an end of the sound tube, the front housing or the rear housing includes a leakage hole, an inner end of the duct is connected to the acoustic path, and an outer end of the duct is connected to the leakage hole, wherein the receiver further includes a protector coupled to the frame of the receiver to protect the diaphragm and disposed to be in contact with the front housing, wherein the duct is formed by a groove located on a front surface of the protector in contact with the front housing.

2. The earphone of claim 1, wherein the leakage hole penetrates a front surface or the rear surface of the front housing.

3. The earphone of claim 1, wherein:

the leakage hole is formed in the rear housing; and the protector includes a connection path formed by the groove on an outer surface and connected to the duct.

4. An earphone having a pressure equilibrium structure, the earphone comprising:

a receiver including a frame, a magnetic circuit, a voice coil, and a diaphragm;

a front housing surrounding a front and a side surface of the receiver and including a sound tube;

a rear housing attached to a rear of the receiver and coupled to the front housing; and a duct located between the diaphragm and the sound tube, wherein an acoustic path through which sound is emitted is formed from the receiver to an end of the sound tube, the front housing or the rear housing includes a leakage hole, an inner end of the duct is connected to the acoustic path, and an outer end of the duct is connected to the leakage hole, wherein the receiver further includes a protector coupled to the frame to protect the diaphragm and disposed to be in contact with the front housing, wherein the duct is formed by a groove located on a rear surface of the front housing in contact with the protector.

5. The earphone of claim 4, wherein the leakage hole penetrates a front surface or a side surface of the front housing.

6. The earphone of claim 4, wherein:

the leakage hole is formed in the rear housing; and the protector includes a connection path formed by a groove on an outer surface and connected to the duct.

7. An earphone having a pressure equilibrium structure, the earphone comprising:

a receiver including a frame, a magnetic circuit, a voice coil, and a diaphragm;

a front housing surrounding a front and a side surface of the receiver and including a sound tube;

a rear housing attached to a rear of the receiver and coupled to the front housing;

a duct located between the diaphragm and the sound tube; and a plate for duct formation coupled to an inner surface of the front housing located at the front, wherein an acoustic path through which sound is emitted is formed from the receiver to an end of the sound tube, the front housing or the rear housing includes a leakage hole, an inner end of the duct is connected to the acoustic path, and an outer end of the duct is connected to the leakage hole.

8. The earphone of claim 7, wherein the plate for duct formation includes a through-hole in the center thereof and includes a groove connected to the through-hole on a surface in contact with the front housing and forming a duct.

9. The earphone of claim 7, wherein the plate for duct formation includes a first plate including a through-hole and a second plate including a hole forming the duct.

10. The earphone of claim 1, wherein the duct has a spiral shape.

11. The earphone of claim 4, wherein the duct has a spiral shape.

12. The earphone of claim 7, wherein the duct has a spiral shape.

* * * * *